US009604458B1

(12) United States Patent
Sugiura et al.

(10) Patent No.: US 9,604,458 B1
(45) Date of Patent: Mar. 28, 2017

(54) LIQUID EJECTING HEAD HAVING SUPPORT MEMBERS FOR SUPPORTING CIRCUIT BOARD

(71) Applicant: Brother Kogyo Kabushiki Kaisha, Nagoya-shi, Aichi-ken (JP)

(72) Inventors: Keita Sugiura, Toyoake (JP); Shohei Koide, Nagoya (JP); Takashi Aiba, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/084,619

(22) Filed: Mar. 30, 2016

(30) Foreign Application Priority Data

Sep. 30, 2015 (JP) ..... 2015-192742

(51) Int. Cl.
*B41J 2/14* (2006.01)

(52) U.S. Cl.
CPC ..... *B41J 2/1433* (2013.01); *B41J 2/14072* (2013.01); *B41J 2002/14491* (2013.01)

(58) Field of Classification Search
CPC ..... B41J 2/14072; B41J 2002/14491
See application file for complete search history.

(56) References Cited

U.S. PATENT DOCUMENTS 9,233,544 B2 1/2016 Akahane et al.
2014/0285574 A1 9/2014 Akahane et al.

FOREIGN PATENT DOCUMENTS

JP 2014-184660 A 10/2014

*Primary Examiner* — Julian Huffman
(74) *Attorney, Agent, or Firm* — Banner & Witcoff, Ltd.

(57) ABSTRACT

A liquid ejecting head includes: a circuit board extending in a first direction and having a first surface and a second surface opposite the first surface in a second direction perpendicular to the first direction; a main body including head units; wiring members each extending from each head unit toward the circuit board; contacts including a first contact and a second contact connected to corresponding wiring members; a first support member facing the first surface; and a second support member facing the second surface. The first support member has a first protrusion protruding toward the first surface in the second direction and arranged at a position aligned with the second contact in the second direction. The second support member has a second protrusion protruding toward the second surface in the second direction and arranged at a position aligned with the first contact in the second direction.

12 Claims, 7 Drawing Sheets

CROSS-SECTION OF END REGION

CROSS-SECTION OF CENTER REGION

LIQUID EJECTING HEAD HAVING SUPPORT MEMBERS FOR SUPPORTING CIRCUIT BOARD

CROSS REFERENCE TO RELATED APPLICATION

This application claims priority from Japanese Patent Application No. 2015-192742 filed Sep. 30, 2015. The entire content of the priority application is incorporated herein by reference.

TECHNICAL FIELD

The present disclosure relates to a liquid ejecting head configured to eject liquid.

BACKGROUND

As a liquid ejecting head, Japanese Patent Application Publication No. 2014-184660 discloses a recording head for an inkjet printer having a plurality of head units (unit heads) aligned in a width direction (width dimension) of a recording sheet.

The conventional liquid ejecting head described above has a circuit board (transmission substrate) electrically connected to the plurality of head units. The circuit board is mounted upright in a case that accommodates the plurality of head units. The head units are arranged on opposing sides of the circuit board with respect to a direction orthogonal to a surface of the circuit board. A wiring member (flexible cable) extends from each head unit toward the circuit board, and a distal end of each wiring member is connected to the circuit board.

Two metal plates are disposed one on either side of the circuit board so as to be separated from the circuit board. The two metal plates serve to reinforce the overall rigidity of the liquid ejecting head. These plates can suppress deformation in the head caused by heat when the wiring members are fixed to the circuit board by thermocompression bonding, for example.

SUMMARY

Since gaps are formed between the circuit board and each metal plate in the conventional liquid ejecting head described above, it is conceivable that the circuit board would deflect toward the side opposite the wiring member when the wiring member is being bonded to the circuit board with pressure. This deflection of the circuit board could result in a defective connection if the wiring member cannot be pressed against the circuit board with sufficient pressure.

In view of the foregoing, it is an object of the present disclosure to provide a liquid ejecting head having a plurality of head units that is capable of improving reliability of electrical connections between wiring members and a circuit board.

In order to attain the above and other objects, the disclosure provides a liquid ejecting head including a circuit board, a main body, a plurality of wiring members, a plurality of contacts, a first support member and a second support member. The circuit board extends in a first direction and has a first surface and a second surface opposite the first surface in a second direction perpendicular to the first direction. The main body includes a plurality of head units, the plurality of head units including a first head unit and a second head unit, the circuit board being interposed between the first head unit and the second head unit in the second direction, the first head unit being arranged offset from the second head unit in the first direction. The plurality of wiring members includes a first wiring member and a second wiring member, the first wiring member extending from the first head unit toward the first surface circuit board and the second wiring member extending from the second head unit toward the second surface of the circuit board. The plurality of contacts is provided in one-to-one correspondence with the plurality of head units, the plurality of contacts including a first contact disposed on the first surface of the circuit board and a second contact disposed on the second surface of the circuit board, the first contact being connected to the first wiring member and the second contact being connected to the second wiring member. The first support member is arranged to face the first surface of the circuit board in the second direction and extends along the first surface, the first support member having a first protrusion protruding toward the first surface in the second direction, the first protrusion being arranged at a position aligned with the second contact in the second direction. The second support member is arranged to face the second surface of the circuit board in the second direction and extends along the second surface, the second support member having a second protrusion protruding toward the second surface in the second direction, the second protrusion being arranged at a position aligned with the first contact in the second direction.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Next, a printer 1 according to an embodiment will be described while referring to FIGS. 1 through 6. The printer 1 according to the embodiment is an inkjet printer configured to print images and the like by ejecting ink droplets from nozzles onto recording sheets.

Figure 1:
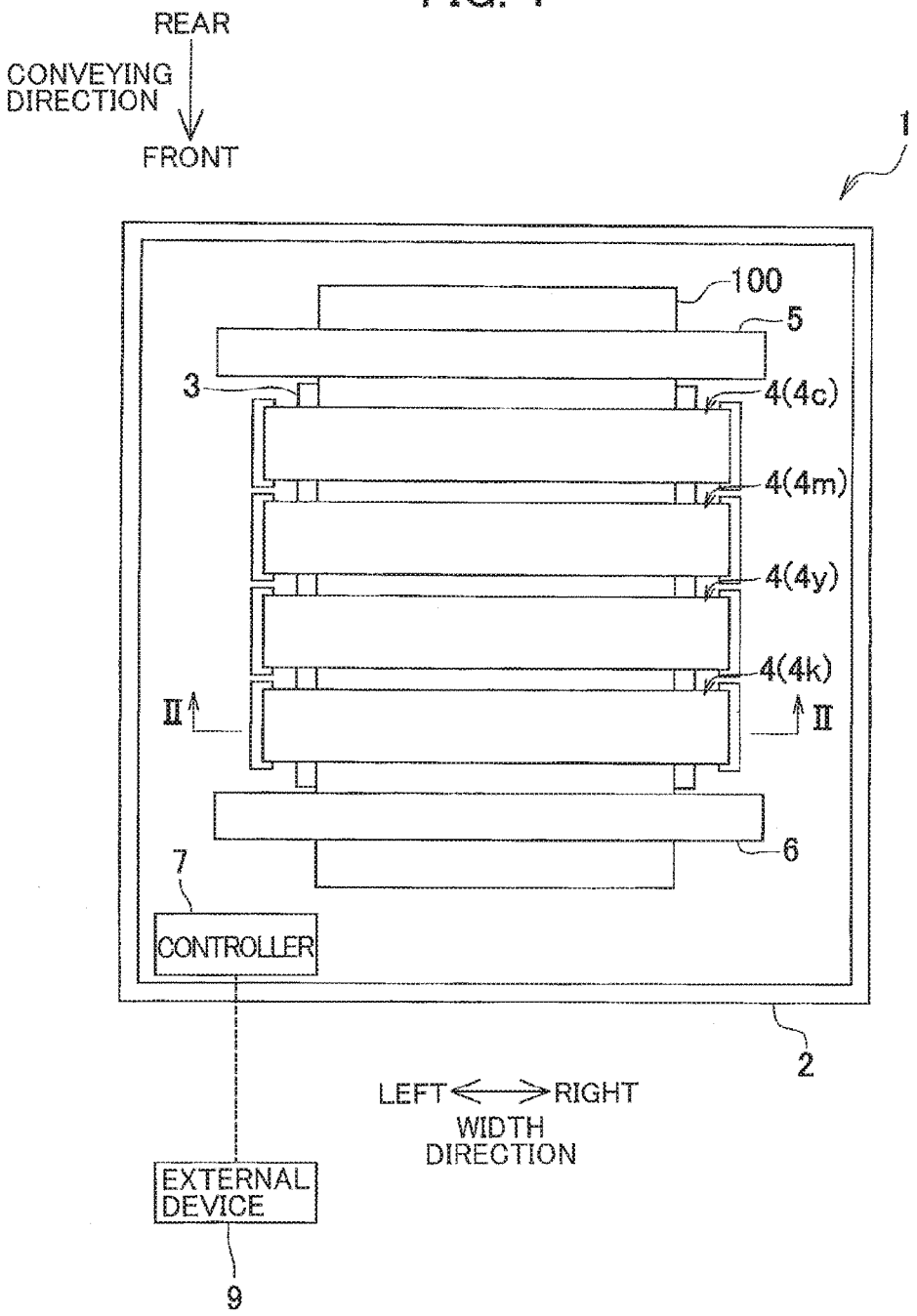
FIG. 1 is a schematic plan view of a printer 1 according to an embodiment.

In the printer 1, a sheet 100 is configured to be conveyed in a conveying direction, as shown in FIG. 1. In the conveying direction, a downstream side will be defined as a front side of the printer 1, while an upstream side will be defined as a rear side of the printer 1. Further, a width direction of the sheet 100 orthogonal to the conveying direction will be defined as a left-right direction of the printer 1. Here, the left side of FIG. 1 corresponds to a left side of the printer 1, and the right side of FIG. 1 corresponds to a right side of the printer 1. A vertical (up-down) direction of the printer 1 is defined as a direction orthogonal to a plane through which the sheet 100 is conveyed (i.e., the direction orthogonal to a sheet surface of FIG. 1). Further, the near side in FIG. 1 corresponds to an upper side of the printer 1, while the far side corresponds to a bottom side of the printer 1. The following description will use directional terms such as front, rear, left, right, up, and down as is appropriate.

<Overall Structure of the Printer>

Figure 2:
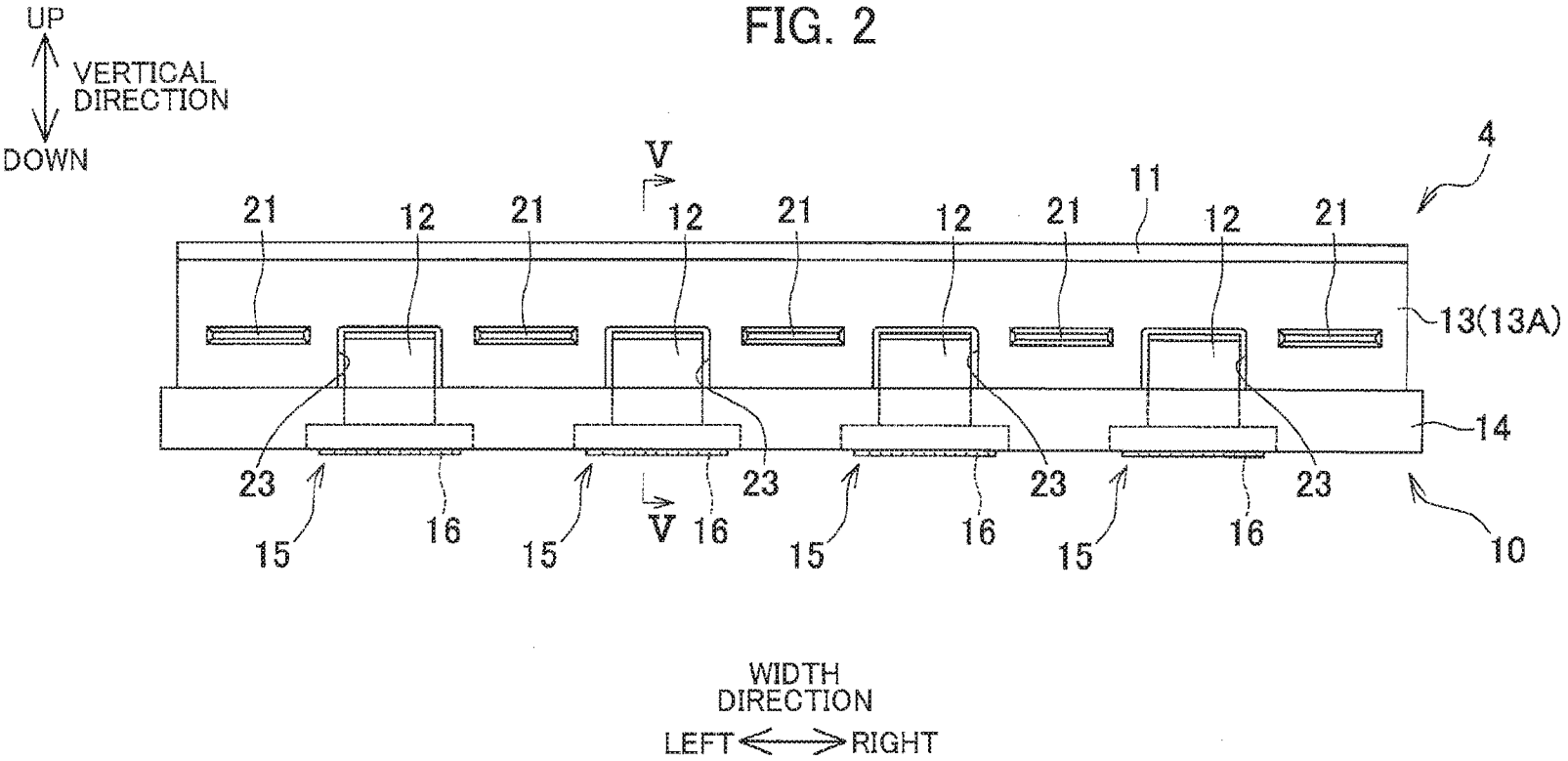
FIG. 2 is a front view of an inkjet head 4 according to the embodiment.

As shown in FIGS. 1 and 2, the printer 1 includes a casing 2 that accommodates a platen 3, four inkjet heads 4, two conveying rollers 5 and 6, and a controller 7.

When conveyed through the printer 1, the sheet 100 is supported on a top surface of the platen 3. The four inkjet heads 4 (4*c*, 4*m*, 4*y*, and 4*k*) are arranged in order in the conveying direction above the platen 3. The inkjet heads 4 (4*c*, 4*m*, 4*y*, and 4*k*) serve to eject ink in their respective colors cyan (C), magenta (M), yellow (Y), and black (K). Ink tanks (not shown) are provided for supplying ink in the corresponding colors to the four inkjet heads 4. Note that the inkjet heads 4 are line-type inkjet heads having a plurality of nozzles 16 (described later with reference to FIG. 6) aligned in the width direction of the sheet 100 (left-right direction).

The conveying roller 5 is disposed on the rear side of the platen 3 (upstream side in the conveying direction), while the conveying roller 6 is disposed on the front side of the platen 3 (downstream side). A motor (not shown) is provided for driving the conveying rollers 5 and 6 to rotate in order to convey the sheet 100 forward over the platen 3.

The controller 7 includes a central processing unit (CPU), a read-only memory (ROM), a random access memory (RAM), a nonvolatile memory such as electrically erasable programmable read-only memory (EEPROM), and an application-specific integrated circuit (ASIC) that includes various control circuits. The controller 7 is also connected to a personal computer or other external device 9 and is capable of performing data communications with the same. The controller 7 is configured to control components of the printer 1 based on print data transmitted from the external device 9.

More specifically, the controller 7 is configured to control the motor such that the conveying rollers 5 and 6 convey the sheet 100 in the conveying direction, and control the inkjet heads 4 to eject ink on the sheet 100 as the sheet 100 is conveyed. Through this operation, the printer 1 can print an image on the sheet 100.

<Structure of the Inkjet Heads>

Next, the structure of the inkjet heads 4 will be described. Since the four inkjet heads 4 all have the same construction, the following description will focus on a single inkjet head 4. As shown in FIGS. 2 through 6, the inkjet head 4 includes a main body 10, a circuit board 11, a plurality of wiring members 12, and two support members 13 (a front support member 13A and a rear support member 13B).

(Main Body)

The main body 10 includes a case member 14, and a plurality (nine in the embodiment) of head units 15 provided in the case member 14.

Figure 3:
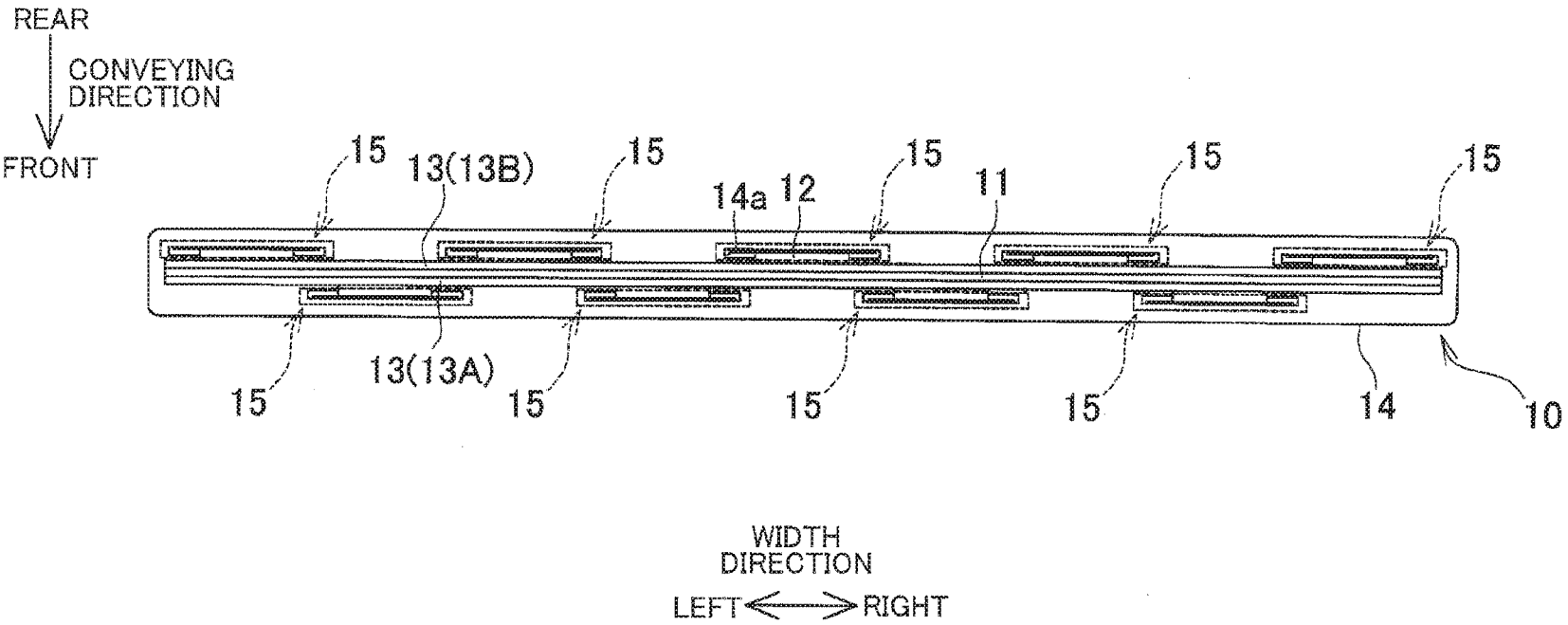
FIG. 3 is a plan view of the inkjet head 4 according to the embodiment.
Figure 6:
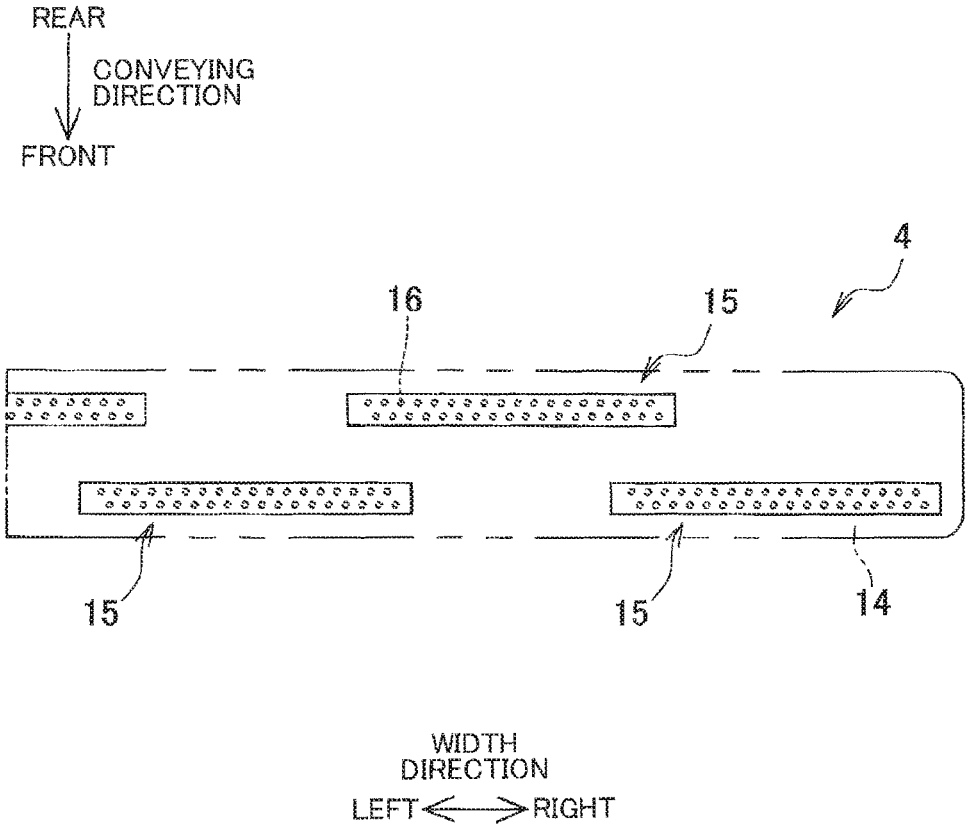
FIG. 6 is a partially-enlarged schematic bottom view of the inkjet head 4 according to the embodiment and showing arrangement of head units 15.

The case member 14 is elongated in the left-right direction coincident with the width direction of the sheet 100. The nine head units 15 are mounted in a bottom portion of the case member 14. As shown in FIGS. 3 and 6, the head units 15 are arranged in two rows aligned in the left-right direction. Further, left-right positions of the head units 15 on the front side are offset from left-right positions of the head units 15 on the rear side. That is, the nine head units 15 are arranged in a staggered formation in a longitudinal direction of the case member 14. Through-holes 14*a* that provide passage for the wiring members 12 described later are formed in a top surface of the case member 14 at positions corresponding to each of the nine head units 15.

The head units 15 have a rectangular planar shape that is elongated in the left-right direction. As shown in FIG. 6, a plurality of nozzles 16 is formed in a bottom surface of each head unit 15. The nozzles 16 are arranged in two rows that are aligned in the left-right direction. While not shown in the drawings, each head unit 15 has a channel member in which are formed ink channels that communicate with the nozzles 16, and an actuator that applies ejection energy to the ink channels in the channel member. While there is no particular limitation on the structure of the actuator, a piezoelectric actuator could be suitably employed, for example. When the actuator applies ejection energy to the ink in an ink channel, an ink droplet is ejected from the nozzle 16 in communication with that ink channel.

(Circuit Board)

The circuit board 11 is a rectangular-shaped substrate. The circuit board 11 is mounted in the case member 14 of the main body 10 in an upright state, with its longitudinal direction aligned in the left-right direction. That is, the circuit board 11 extends in the left-right direction. The left-right direction is an example of a first direction. The circuit board 11 extends upward from the case member 14 between the two rows of head units 15. To rephrase that, the nine head units 15 described earlier are divided into two groups arranged on opposite sides of the circuit board 11 with respect to the front-rear direction, which is orthogonal to the longitudinal direction (left-right direction) of the circuit board 11, as shown in FIG. 3. The front-rear direction is an example of a second direction. The four head units 15 disposed on the front side of the circuit board 11 are an example of a first head unit, while the head units 15 disposed on the rear side of the circuit board 11 are an example of a second head unit.

The circuit board 11 is connected to the controller 7 of the printer 1 by a flexible cable (not shown).

Figure 5:
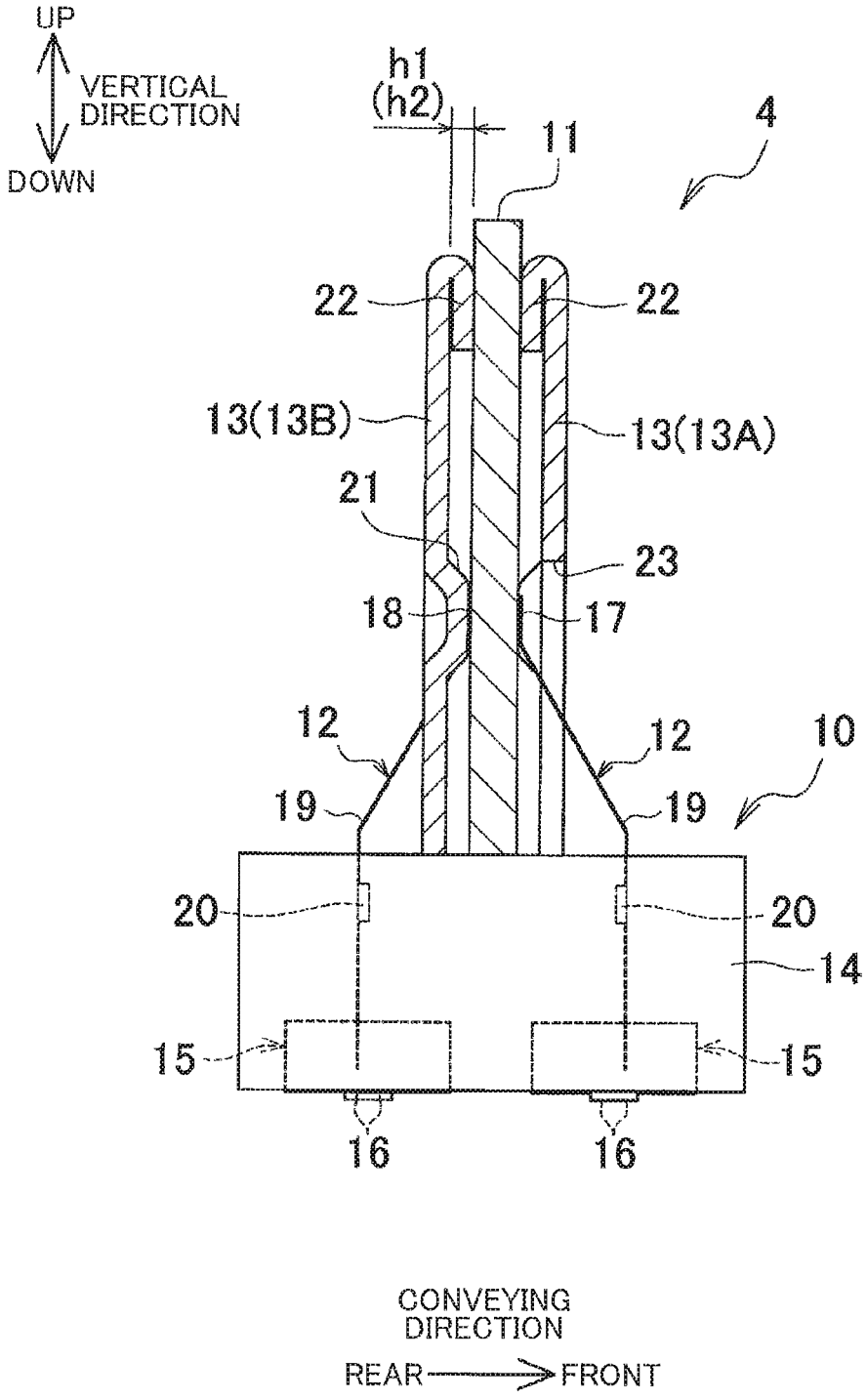
FIG. 5 is a cross-sectional view of the inkjet head 4 according to the embodiment taken along a line V-V shown in FIG. 2.

Various circuit elements are incorporated in the circuit board 11 for controlling each of the head units 15. As shown in FIG. 5, contacts 17 are also provided on both front and rear surfaces of the circuit board 11 at positions corresponding to the head units 15. More specifically, four of the contacts 17 are provided in a vertical center region on the front surface of the circuit board 11 at positions corresponding to the four head units 15 positioned on the front side of the circuit board 11, and five of the contacts 17 are provided in a vertical center region on the rear surface of the circuit board 11 at positions corresponding to the five head units 15 positioned on the rear side of the circuit board 11. The four contacts 17 on the front surface of the circuit board 11 are arranged offset in the left-right direction from the five contacts 17 on the rear surface of the circuit board 11 according to the arrangement of the head units 15. The front surface of the circuit board 11 is an example of a first surface, and the rear surface of the circuit board 11 is an example of a second surface. The four contacts 17 disposed on the front surface of the circuit board 11 are an example of a first contact, while the five contacts 17 disposed on the rear surface of the circuit board 11 are an example of a second contact.

As shown in FIG. 5, ground wirings 18 are formed on both front and rear surfaces of the circuit board 11 at positions aligned with the contacts 17 formed on the opposite surface of the circuit board 11 in the front-rear direction. Note that it is not necessary to provide ground wirings 18 at positions corresponding to all contacts 17 on the opposing side of the circuit board 11, provided that the ground wirings 18 are provided at positions on the opposite side of the circuit board 11 from some of the contacts 17.

(Wiring Members)

The wiring members 12 are connected to the corresponding head units 15. As shown in FIG. 5, each wiring member 12 is configured of a chip-on-film (COF) having a film-like resin substrate 19 on which are formed a plurality of interconnects, and a driver IC 20 mounted on the resin substrate 19. The wiring member 12 extends upward from a corresponding head unit 15 and passes through a corresponding through-hole 14*a* formed in the case member 14. The wiring member 12 has a distal end portion that is electrically connected to a corresponding contact 17 formed on the front or rear surface of the circuit board 11 via a conductive adhesive, such as anisotropic conductive film (ACF) or anisotropic conductive paste (ACP).

As described above, the circuit board 11 is connected to the controller 7 of the printer 1 by a flexible cable. The circuit board 11 is also connected to each of the head units 15 by the wiring members 12 having the corresponding driver ICs 20 mounted thereon. The circuit board 11 can transmit signals to the driver IC 20 of each wiring member 12 for controlling the corresponding head unit 15 based on signals received from the controller 7. The driver IC 20 can output a drive signal to the corresponding head unit 15 for driving the actuator based on the signals received from the circuit board 11.

(Support Members)

The two support members 13 (13A, 13B) are both metal plates formed of aluminum, copper, or the like. The support members 13 are arranged alongside the circuit board 11, with the front support member 13A disposed on the front side of the circuit board 11 and the rear support member 13B disposed on the rear side. Bottom ends of the support members 13 are mounted in the case member 14. Each support member 13 extends upward from the case member 14 and parallel to the circuit board 11. The vertical direction is an example of a third direction. The front support member 13A is an example of a first support member, while the second support member 13B is an example of a second support member.

Openings 23 are formed in a lower half of each support member 13 for exposing the contacts 17 of the circuit board 11 in the support member 13. Four openings 23 are formed in the front support member 13A at positions corresponding to the four contacts 17 on the front surface of the circuit board 11, and five openings 23 are formed in the rear support member 13B at positions corresponding to the five contacts 17 on the rear surface of the circuit board 11. Each opening 23 has a greater left-right width than a width of the corresponding contact 17. A top edge defining each opening 23 is positioned higher than a top edge of the corresponding contact 17. Thus, outlines of the contacts 17 viewed in the front-rear direction, orthogonal to the surface of the circuit board 11, fit entirely within outlines of the corresponding openings 23. The distal end portions of the wiring members 12 extending upward from the corresponding head units 15 are connected to the contacts 17 exposed in the corresponding openings 23.

The distal end portion of each wiring member 12 is connected to the circuit board 11 by thermocompression bonding while a conductive adhesive is interposed between the distal end portion of the wiring member 12 and the circuit board 11. Here, the support member 13 disposed on the opposite side of the circuit board 11 from the contact 17 to which the wiring member 12 is being bonded can support the circuit board 11 on its back side as the wiring member 12 is pressed against the circuit board 11.

Since the support members 13 are configured of metal plates in the embodiment, heat generated when the wiring member 12 is connected to the circuit board 11 by thermocompression bonding is partially transmitted through and dissipated from the metal plates. In addition, the support members 13 arranged on both sides of the circuit board 11 function as electromagnetic shields covering the circuit board 11. That is, the metal support members 13 can block external electromagnetic interference (noise) to prevent such noise from reaching the circuit board 11.

However, if the support members 13 are spaced apart from the circuit board 11, the circuit board 11 is deflected when the wiring member 12 is pressed against the circuit board 11. In such cases, it may not be possible to press the wiring member 12 against the circuit board 11 with sufficient force, potentially resulting in a defective connection. On the other hand, if the support members 13 are arranged to closely contact the entire side surfaces of the circuit board 11, wiring and the like formed on the circuit board 11 will be in contact with the support members 13, potentially leading to short-circuiting among wiring on the circuit board 11, particularly when the support members 13 are formed of metal plates.

Accordingly, in the present embodiment, the support members 13 are provided with protruding parts (first protrusions 21 and second protrusions 22) for partially supporting the circuit board 11.

(1) First Protrusions

The first protrusions 21 are provided in areas of the support members 13 aligned with contacts 17 positioned on the opposite side of the circuit board 11 in the front-rear direction and protrude toward the circuit board 11. More specifically, five first protrusions 21 are provided on the front support member 13A at positions corresponding to the five contacts 17 provided on the rear surface of the circuit board 11 in the front-rear direction. Similarly, four first protrusions 21 are provided on the rear support member 13B at positions corresponding to the four contacts 17 provided on the front surface of the circuit board 11 in the front-rear direction. The five first protrusions 21 formed in the front support member 13A are an example of a first protrusion. The four first protrusions 21 formed in the rear support member 13B are an example of a second protrusion.

The first protrusions 21 have vertical and left-right dimensions greater than those of the contacts 17. Hence, the outlines of the contacts 17 viewed in the front-rear direction, orthogonal to the longitudinal direction of the circuit board 11, fit entirely within outlines of the first protrusions 21. As shown in FIG. 2, the first protrusions 21 of the support members 13 are arranged alternately in the left-right direction with the top edges of the openings 23 formed to expose the contacts 17. That is, the first protrusions 21 and the contacts 17 are arranged alternately in the left-right direction. Further, a protruding end of each first protrusion 21 is in contact with the circuit board 11, as shown in FIG. 5.

The first protrusions 21 are formed in the support member 13 by performing a metalworking process called press drawing on sheet metal. Through this process, localized portions of the support member 13 are drawn into a die to form the first protrusions 21 that protrude toward the circuit board 11.

When connecting the wiring members 12 to the corresponding contacts 17 in the inkjet head 4 having the above construction, the first protrusions 21 positioned on the opposite side of the circuit board 11 from the contacts 17 support the back side of the circuit board 11. Here, the first protrusions 21 are in contact with the circuit board 11 and, therefore, can reliably support the circuit board 11. Since the first protrusions 21 prevent the circuit board 11 from bending, the wiring members 12 can be reliably pressed against and connected to the corresponding contacts 17.

Note that there is no particular restriction on the method of forming the first protrusions 21, but the first protrusions 21 in the embodiment are formed by locally drawing portions of sheet metal configuring the support member 13. With this method, the first protrusions 21 can be formed simply. Alternatively, protrusions serving as the first protrusions 21 may be formed by affixing separate members formed of resin or the like to the support member 13. However, this method is less cost-effective than the method used in the embodiment.

Further, the ground wirings 18 are formed on the front and rear surfaces of the circuit board 11 in areas aligned with the contacts 17 provided on the opposite surface of the circuit board 11 in the front-rear direction, as shown in FIG. 5. Accordingly, the first protrusions 21 positioned on the side of the circuit board 11 opposite the corresponding contacts 17 are in contact with the ground wirings 18. This configuration can ground the support member 13, preventing the generation of static electricity.

(2) Second Protrusions

Figure 4:
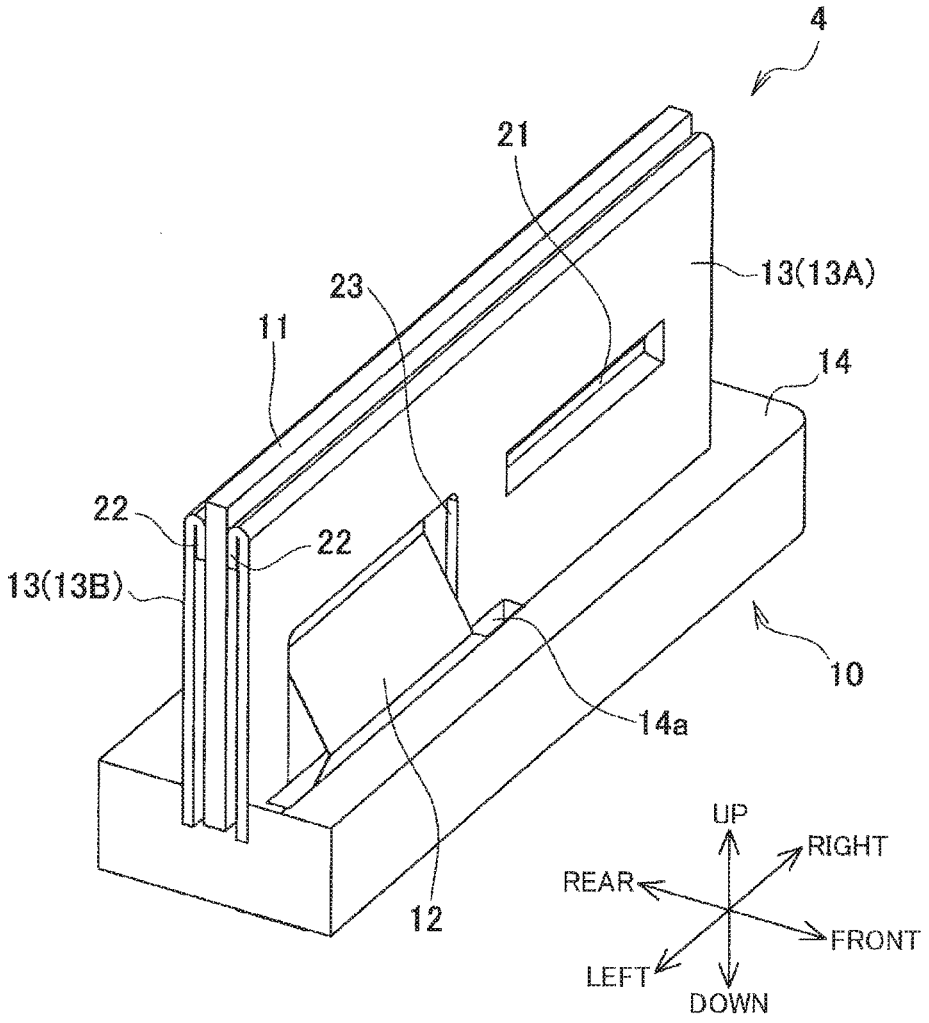
FIG. 4 is a perspective view illustrating a portion of the inkjet head 4 according to the embodiment.

As shown in FIGS. 4 and 5, the second protrusions 22 are provided on top edges of the support members 13, i.e., the edges opposite the edges (bottom edges) that are mounted in the main body 10, and protrude toward the circuit board 11. Hence, the second protrusions 22 are positioned above the contacts 17 and first protrusions 21. The second protrusion 22 provided on the front support member 13A is an example of a first projection. The second protrusion 22 provided on the rear support member 13B is an example of a second projection.

The second protrusions 22 are formed by bending the top edges of the support members 13 toward the circuit board 11 so that the top edges are doubled over across the entire left-right dimension of the support members 13.

Since the second protrusions 22 are provided on the support members 13 separately from the first protrusions 21, the circuit board 11 is supported not only by the first protrusions 21, but also by the second protrusions 22 positioned apart from the first protrusions 21 when the wiring members 12 are being bonded. Accordingly, this construction can better suppress deflection of the circuit board 11 in order to achieve more reliable connections. Note that a protruding length h1 of the first protrusions 21 is preferably equivalent to a protruding length h2 of the second protrusions 22 in order that the support members 13 can be more easily maintained in an orientation substantially parallel to the circuit board 11 to suppress deflection of the same.

Further, while there is no particular restriction on the method of forming the second protrusions 22, in the embodiment the second protrusions 22 are formed by bending the top edge of each support member 13 so that the top edge is folded down on each support member 13 itself. In this way, the second protrusions 22 can be formed simply by bending the top edges of sheet metal. Further, bending the edges of the support members 13 enhances their stiffness or rigidity, improving their function for supporting the circuit board 11.

The stiffness of the support members 13 is further enhanced by extending the second protrusions 22 across the entire left-right dimension of the support members 13 (along the longitudinal dimension of the circuit board 11). Further, extending the second protrusions 22 across the entire top edge of the support member 13 in the left-right direction can prevent gaps from being formed between the circuit board 11 and the support members 13, thereby more reliably shielding the circuit board 11 from external noise coming from above.

While the description has been made in detail with reference to specific embodiment thereof, it would be apparent to those skilled in the art that various changes and modifications may be made therein without departing from the scope of the above described embodiment.

[1] In order to reliably prevent the circuit board 11 from deflecting when connecting the wiring members 12, it is preferable that the first protrusions 21 of the support member 13 positioned on the back side of the circuit board 11 (the opposite side of the wiring member 12 being connected) are in contact with the circuit board 11. However, this configuration reduces the flexibility of laying out elements configured of wiring and circuits since such elements cannot be arranged in regions of the circuit board 11 that are contacted by the first protrusions 21. From this perspective, the first protrusions 21 may be spaced apart from the circuit board 11.

[2] The first protrusions 21 provided on each support member 13 may have different protruding lengths. The following points may be considered when determining the positions at which the first protrusions 21 should be given a longer protruding length.

The ease at which the circuit board 11 deflects when a wiring member 12 is pressed against the circuit board 11 differs depending on whether the wiring member 12 is pressed against a longitudinal (left-right) end region of the circuit board 11 or a center region of the circuit board 11. That is, the center region tends to deflect more readily than the end regions. Therefore, if the first protrusions 21 positioned on the end regions are spaced apart from the circuit board 11, the circuit board 11 may break before deflecting far enough to contact the first protrusions 21 formed on the back side of the circuit board 11 when one of the wiring members 12 is pressed firmly against the end region of the circuit board 11.

Figure 7A:
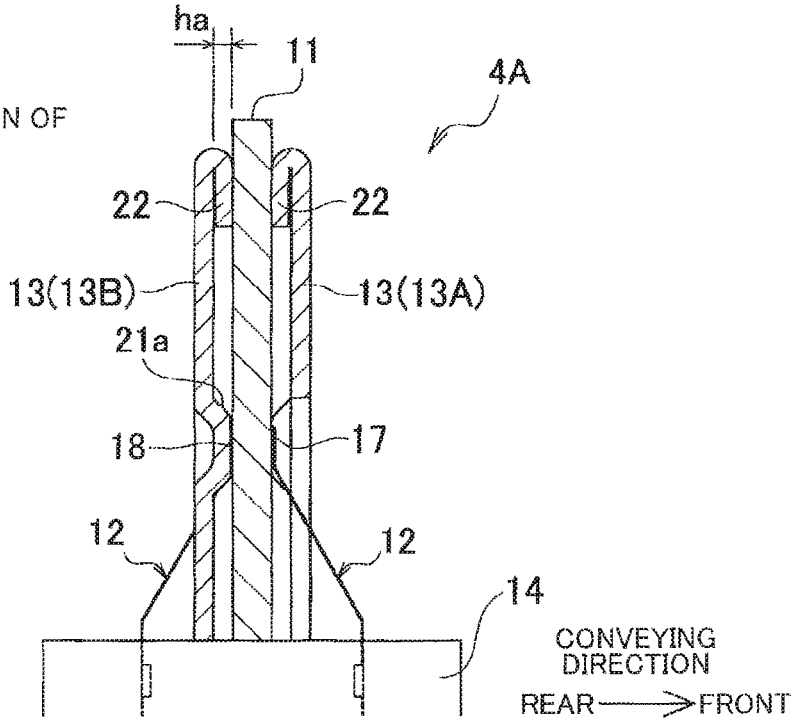
FIG. 7A is a cross-sectional view corresponding to FIG. 5 of an end region of an inkjet head 4A according to a modification to the embodiment.
Figure 7B:
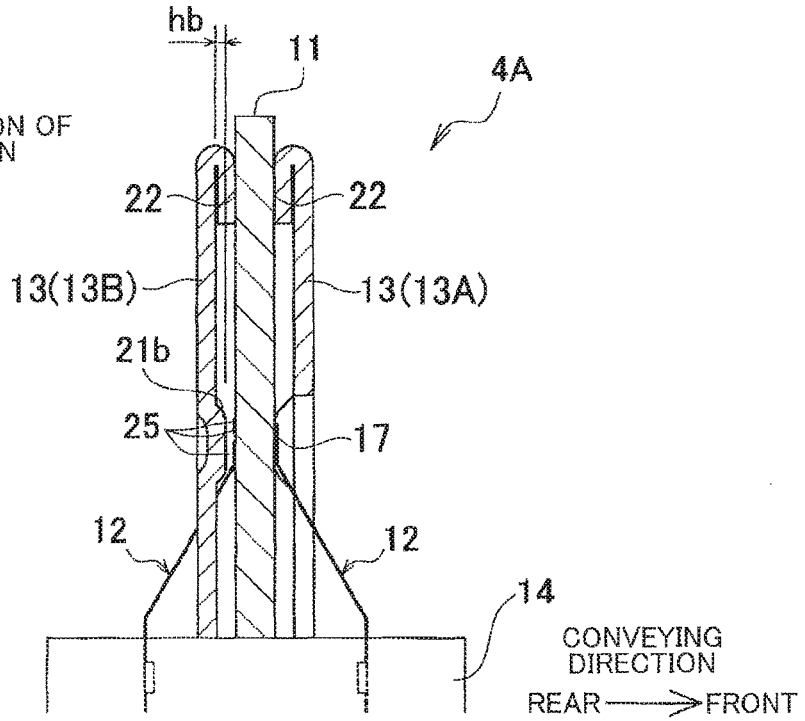
FIG. 7B is a cross-sectional view corresponding to FIG. 5 of a center region of the inkjet head 4A according to the modification.

FIGS. 7A and 7B show an inkjet head 4A according to a modification to the embodiment. In this modification, the plurality of first protrusions 21 provided on each support member 13 includes side first protrusions 21*a* positioned on left and right end regions on the support member 13, and center first protrusions 21*b* positioned toward the center from the side first protrusions 21*a*. The side first protrusions 21*a* on the front support member 13A are an example of an end first protrusion, while the center first protrusions 21*b* on the front support member 13A are an example of a center first protrusion. Likewise, the side first protrusions 21*a* on the rear support member 13B are an example of an end second protrusion, while the center first protrusions 21*b* on the rear support member 13B are an example of a center second protrusion.

The side first protrusions 21*a* have a protruding length ha that is greater than a protruding length hb of the center first protrusions 21*b*. Since the side first protrusions 21*a* have a large protruding length ha, the circuit board 11 will contact the side first protrusions 21*a* after bending a slight amount when pressed by a wiring member 12, thereby preventing damage to the circuit board 11. On the other hand, since the center first protrusions 21*b* have a smaller protruding length hb, the center first protrusions 21*b* remain separated from the circuit board 11, except when the circuit board 11 is pressed by a wiring member 12. This configuration facilitates arrangement of wirings 25 and the like in the center region of the circuit board 11, improving the flexibility of the layout design.

Further, the side first protrusions 21*a* that protrude at the greater length ha are preferably in contact with the circuit board 11 (the ground wirings 18), while the center first protrusions 21*b* having the smaller protruding length hb are preferably separated from the circuit board 11. Since the side first protrusions 21*a* are normally in contact with the circuit board 11, the side first protrusions 21*a* can reliably suppress deflection of the circuit board 11 when connecting wiring members 12.

[3] The first protrusions and second protrusions are not restricted to structures formed by drawing and bending type metalworking processes. For example, the first and second protrusions may be formed by depositing a liquid thermosetting resin on the support members and curing the resin with heat.

[4] In the embodiment described above, the second protrusion 22 is formed on each support member 13 in addition to the first protrusions 21 corresponding to the contacts 17, but the second protrusion is not essential and may be omitted.

[5] In the embodiment described above, one support member 13 is disposed on each of the front and rear sides of the circuit board 11 and extends along the longitudinal dimension of the circuit board 11, but support members may be arranged in divisions around the head units 15. For example, when the head units 15 are arranged as in FIG. 3, five support members may be provided on the front side of the circuit board 11 at positions corresponding to the five head units 15 on the rear side, and four support members may be provided on the rear side of the circuit board 11 at positions corresponding to the four head units 15 on the front side.

[6] The support members are also not limited to metal, but may be formed of a nonmetallic material. However, in order to function as members that support the circuit board, the support members should have at least a certain degree of stiffness or rigidity. Hence, the support members could be formed of a high-strength nonmetallic material such as a rigid plastic.

[7] A plurality of first protrusions (first protrusions 21) is provided on each support member 13 disposed in the embodiment described above, but a single first protrusion may be formed on each support member 13. Even providing a single first protrusion can better suppress deflection of the circuit board 11 when connecting wiring members 12, rather than providing no first protrusion on each support member 13. When providing a single first protrusion, the protrusion should be preferably disposed near a center of each support member 13 in a longitudinal direction thereof.

What is claimed is:

1. A liquid ejecting head comprising:

a circuit board extending in a first direction and having a first surface and a second surface opposite the first surface in a second direction perpendicular to the first direction;

a main body including a plurality of head units, the plurality of head units comprising a first head unit and a second head unit, the circuit board being interposed between the first head unit and the second head unit in the second direction, the first head unit being arranged offset from the second head unit in the first direction;

a plurality of wiring members comprising a first wiring member and a second wiring member, the first wiring member extending from the first head unit toward the first surface of the circuit board and the second wiring member extending from the second head unit toward the second surface of the circuit board;

a plurality of contacts provided in one-to-one correspondence with the plurality of head units, the plurality of contacts comprising a first contact disposed on the first surface of the circuit board and a second contact disposed on the second surface of the circuit board, the first contact being connected to the first wiring member and the second contact being connected to the second wiring member;

a first support member arranged to face the first surface of the circuit board in the second direction and extending along the first surface, the first support member having a first protrusion protruding toward the first surface in the second direction, the first protrusion being arranged at a position aligned with the second contact in the second direction; and a second support member arranged to face the second surface of the circuit board in the second direction and extending along the second surface, the second support member having a second protrusion protruding toward the second surface in the second direction, the second protrusion being arranged at a position aligned with the first contact in the second direction.

2. The liquid ejecting head according to claim 1, wherein the first protrusion is in contact with the first surface of the circuit board and the second protrusion is in contact with the second surface of the circuit board.

3. The liquid ejecting head according to claim 1, wherein the first protrusion comprises a plurality of first protrusions aligned with one another in the first direction, the plurality of first protrusions including an end first protrusion arranged outermost in the first direction and a center first protrusion arranged inward of the end first protrusion in the first direction, the end first protrusion having a protruding length greater than a protruding length of the center first protrusion in the second direction, and wherein the second protrusion comprises a plurality of second protrusions aligned with one another in the first direction, the plurality of second protrusions including an end second protrusion arranged outermost in the first direction and a center second protrusion arranged inward of the end second protrusion in the first direction, the end second protrusion having a protruding length greater than a protruding length of the center second protrusion in the second direction.

4. The liquid ejecting head according to claim 3, wherein the end first protrusion is in contact with the first surface of the circuit board but the center first protrusion is separated from the first surface of the circuit board, and wherein the end second protrusion is in contact with the second surface of the circuit board but the center second protrusion is separated from the second surface of the circuit board.

5. The liquid ejecting head according to claim 1, wherein the first support member and the second support member are respectively formed of metal plates.

6. The liquid ejecting head according to claim 5, wherein the first protrusion is formed by locally drawing the first support member, and wherein the second protrusion is formed by locally drawing the second support member.

7. The liquid ejecting head according to claim 5, further comprising:

a first ground wiring provided on the first surface of the circuit board and arranged to be aligned with the second contact in the second direction, the first protrusion being in contact with the first ground wiring; and a second ground wiring provided on the second surface of the circuit board and arranged to be aligned with the first contact in the second direction, the second protrusion being in contact with the second ground wiring.

8. The liquid ejecting head according to claim 1, wherein the first contact comprises a plurality of first contacts aligned with one another in the first direction and the second contact comprises a plurality of second contacts aligned with one another in the first direction, wherein the first protrusion comprises a plurality of first protrusions aligned with one another in the first direction and the second protrusion comprises a plurality of second protrusions aligned with one another in the first direction, wherein the plurality of first contacts and the plurality of first protrusions are arranged alternately in the first direction, and wherein the plurality of second contacts and the plurality of second protrusions are arranged alternately in the first direction.

9. The liquid ejecting head according to claim 1, wherein the first support member extends from the main body in a third direction perpendicular to the first direction and the second direction, the first support member having one end supported by the main body and another end opposite the one end in the third direction, the first support member further including a first projection protruding toward the first surface of the circuit board, the first projection being provided on the another end of the first support member, and wherein the second support member extends from the main body in the third direction, the second support member having one end supported by the main body and another end opposite the one end in the third direction, the second support member further including a second projection protruding toward the second surface of the circuit board, the second projection being provided on the another end of the second support member.

10. The liquid ejecting head according to claim 9, wherein the first projection is formed by bending the another end of the first support member toward the first surface of the circuit board, and wherein the second projection is formed by bending the another end of the second support member toward the second surface of the circuit board.

11. The liquid ejecting head according to claim 9, wherein the first protrusion and the first projection have a protruding length identical to each other in the second direction, and wherein the second protrusion and the second projection have a protruding length identical to each other in the second direction.

12. The liquid ejecting head according to claim 9, wherein the first projection extends across an entire dimension of the another end of the first support member in the first direction, and wherein the second projection extends across an entire dimension of the another end of the second support member in the first direction.

* * * * *